US005552018A

United States Patent [19]

Devenyns

[11] Patent Number: 5,552,018

[45] Date of Patent: Sep. 3, 1996

[54] A PROCESS FOR DELIGNIFYING PULP WITH ORGANIC PEROXYACID IN THE PRESENCE OF PHOSPHONIC ACIDS AND THEIR SALTS

[75] Inventor: Johan Devenyns, Brussels, Belgium

[73] Assignee: Solvay Interox (Societe Anonyme), Brussels, Belgium

[21] Appl. No.: 83,180

[22] Filed: Jun. 29, 1993

[30] Foreign Application Priority Data

Jul. 6, 1992 [BE] Belgium ..... 09200627

[51] Int. Cl.[6] ..... D21C 9/16

[52] U.S. Cl. ..... 162/76; 162/78; 162/80

[58] Field of Search ..... 162/72, 76, 19, 162/78, 80

[56] References Cited

U.S. PATENT DOCUMENTS 4,400,237 8/1983 Kruger et al. ..... 162/76

FOREIGN PATENT DOCUMENTS 0415149 10/1990 European Pat. Off. .
0402335 12/1990 European Pat. Off. .
1014536 8/1952 France .
57-21591 2/1982 Japan .

OTHER PUBLICATIONS

Du Plooy, ABJ., "Non Chlorine Bleaching of Chemical Pulp– A development study", 1984, National Research Inst., pp. 20–21.

Kuczynski et al., "DTPMPA: Polyamino Polyphosphonic acid and its use in paper processes", Jun. 1988 TAPPI Journal, 171–174.

Yotsuya, M. et al, Jap.Pat. 21,591/82, "Bleaching of Pulp with Peroxide", 1004 Abstract Bulletin of the Institute of Paper Chemistry, vol. 53,No.4, Oct. 1982, No. 4578.

K. Kuczynski et al, "DTPMPA:plyamino polyphosphonic acid and its use in paper processes . . . ", TAPPI Journal, (PCT 158) 872, No. 6, Jun. 1988, pp. 171–174.

Ullmann's Encyclopedia of Industrial Chemistry, 5th Ed. vol. A18, 1991; pp. 568–569.

*Primary Examiner*—David L. Lacey
*Assistant Examiner*—Dean T. Nguyen
*Attorney, Agent, or Firm*—Spencer & Frank

[57] ABSTRACT

Process for improving the selectivity of the delignification of a chemical paper pulp by employing a peroxyacid, in which the unbleached pulp originating from the cooking operation is treated with an aqueous solution of this organic peroxyacid in the presence of at least one stabilizer selected from phosphonic acids and their salts.

12 Claims, No Drawings

A PROCESS FOR DELIGNIFYING PULP WITH ORGANIC PEROXYACID IN THE PRESENCE OF PHOSPHONIC ACIDS AND THEIR SALTS

BACKGROUND OF THE INVENTION

The invention relates to a process for delignification of a chemical paper pulp.

It is known to apply to unbleached chemical paper pulps obtained by cooking cellulosic matter in the presence of chemical reactants a sequence of delignifying and bleaching treatment stages involving the use of oxidising chemical products. The objective of the first stage of a conventional sequence of bleaching chemical pulp is to complete the delignification of the unbleached pulp, such as it is after the cooking operation. This first delignifying stage is conventionally carried out by treating the unbleached pulp with chlorine in an acidic medium or with a chlorine-chlorine dioxide combination, as a mixture or sequentially, so as to cause a reaction with the residual lignin in the pulp and to give rise to chlorolignins which will be capable of being extracted from the pulp by solubilisation of these chlorolignins in an alkaline medium in a subsequent stage of treatment.

For various reasons it is found to be useful, in some situations, to be able to replace this first delignifying stage with a treatment which no longer calls for a chlorine-containing reactant.

It has already been proposed to treat a kraft pulp using a first stage with oxygen, followed by a stage with peracetic acid at 70° C. in the presence of diethylenetriaminepentaacetic acid (DTPA) (Patent Application JP-55/94811 in the name of Mitsubishi Gas Chemical). In this known process the presence of the DTPA stabiliser prevents a considerable degradation of the cellulose chains. However, the protective effect of the stabiliser does not yet reach the sufficient level required for the production of high quality pulps.

SUMMARY OF THE INVENTION

The invention is aimed at overcoming the disadvantages of the known processes by providing a process which carries out an efficient delignification of the unbleached paper pulp, which makes it possible to obtain pulps exhibiting high intrinsic qualities over a wide temperature range.

To this end, the invention relates to a process for improving the selectivity of the delignification of a chemical paper pulp by means of an organic peroxyacid, in which the unbleached pulp originating from the cooking operation is treated with an aqueous solution of this organic peroxyacid in the presence of a stabiliser for the said peroxyacid, comprising at least one compound selected from the class of phosphonic acids and their salts.

DETAILED DESCRIPTION OF THE INVENTION

According to the invention, a chemical paper pulp is intended to denote pulps which have already undergone a delignifying treatment in the presence of chemical reactants such as sodium sulphide in alkaline medium (kraft or sulphate cooking), sulphur dioxide or a metal salt of sulphurous acid in an acidic medium (sulphite or bisulphite cooking). According to the invention a chemical paper pulp is also intended to denote the pulps which are called "semi-chemical pulps" in the literature, such as those where the cooking has been carried out with the aid of a salt of sulphurous acid in a neutral medium (neutral sulphite cooking also known as NSSC cooking), as well as the pulps obtained by processes employing solvents, such as the Organosolv, Alcell®, Organocell® and Asam pulps which are described in Ullmann's Encyclopedia of Industrial Chemistry, 5th edition, Vol. A18, 1991, pages 568 and 569.

The invention applies particularly to the pulps which have undergone a kraft cooking. All kinds of woods employed for the production of chemical pulps are suitable for making use of the process of the invention and, in particular, those employed for kraft pulps, namely coniferous woods such as, for example, the various species of pine and fir, and deciduous woods such as, for example, beech, oak, eucalyptus and hornbeam.

According to a first alternative form of the invention the organic peroxyacid is usually selected from performic acid and carboxylic aliphatic peroxyacids containing a single percarboxylic group and a linear or branched saturated alkyl chain of fewer than 11 carbon atoms. Aliphatic carboxylic peroxyacids containing a linear saturated alkyl chain containing fewer than 6 carbon atoms are preferred. Examples of such peroxyacids are peracetic acid, perpropanoic acid, per-n-butanoic acid and per-n-pentanoic acid. Peracetic acid is particularly preferred because of its effectiveness and the relative simplicity of methods for its preparation.

In an alternative form of the process according to the invention the organic peroxyacid is selected from diperoxycarboxylic acids containing a linear or branched alkyl chain of fewer than 16 carbon atoms and two percarboxylic groups substituted on carbon atoms situated in alpha-omega positions relative to one another. Examples of such peroxyacids are 1,6-hexanediperoxydioic acid, 1,8-octanediperoxydioic acid and 1,10-decanediperoxydioic acid and 1,12-dodecanediperoxydioic acid.

In another alternative form of the process according to the invention the organic peroxyacid is selected from aromatic peroxyacids containing at least one percarboxylic group per benzene nucleus. The aromatic peroxyacids containing only a single percarboxylic group per benzene nucleus will be preferably chosen. An example of such an acid is peroxybenzoic acid.

Another alternative form of the process according to the invention consists in choosing an organic peroxyacid substituted by one or more halogen atoms or by any other organic functional substituent. Any other organic functional substituent is intended to denote a functional group such as the carbonyl group (ketone, aldehyde or carboxylic acid), the alcohol group, nitrogen-containing groups such as nitrile, nitro, amine and amide groups, and sulphur-containing groups such as sulpho and mercapto groups.

The peroxyacid employed may be a commercial aqueous solution containing at least 10% by weight of peroxyacid, in equilibrium with at least 12% by weight of the corresponding organic acid and at least 1.5% by weight of hydrogen peroxide in most cases in the presence of a small quantity of catalyst in the form of at least 0.3% by weight of a strong acid, generally an inorganic acid. An example of commercial organic peroxyacid composition which is suitable is a concentrated aqueous solution of peracetic acid containing approximately 34% by weight of peracetic acid, approximately 44% by weight of acetic acid, approximately 5% by weight of hydrogen peroxide and approximately 1% by weight of sulphuric acid. It is also possible to prepare the peroxyacid immediately before its use by reaction, in appropriate conditions, of acetic acid at a concentration of 50 to 100% by weight with a concentrated aqueous solution of hydrogen peroxide at a concentration of 30 to 85% by weight, in the presence of a small quantity of an inorganic acid as catalyst.

The peroxyacid can equally well be used in the state of an aqueous solution of peroxyacid or in the form of an ammonium, alkali metal or alkaline-earth metal salt of this peroxyacid.

The peroxyacid treatment according to the invention may be performed over a wide range of temperatures. In general the treatment will be performed with peroxyacid at a temperature of at least 2° C. and preferably of at least 20° C. Similarly, this temperature generally does not exceed 98° C. and, preferably 95° C. The process according to the invention is particularly well suited to the use of elevated temperatures, that is to say of at least 50° C. and, preferably, of at least 75° C.

The treatment with the organic peroxyacid is generally performed at atmospheric pressure. The duration of this treatment depends on the temperature and on the wood species which has been used to prepare the pulp, and on the effectiveness of the preceding cooking. Periods of between 120 minutes and approximately 360 minutes are suitable.

The pH of the stage of the treatment with the peroxyacid may lie equally well in the acidic pH or alkaline pH range. However, moderately acidic pH values are preferred. In practice it is preferred to fix the pH at a value of at least 3.5. In most cases it will also be appropriate not to exceed a pH value of 6.5.

The treatment according to the invention can take place in any type of suitable apparatus for the treatment of paper pulp by means of acidic reactants. The unbleached pulp holder vessel present in all bleaching plants and acting as a buffer storage vessel between the wood cooking unit and the pulp bleaching unit is particularly suitable for carrying out the process according to the invention. The pulp can thus be treated therein while it is stored without it being necessary to invest in costly dedicated equipment.

The consistency of the pulp in the stage of treatment with the organic peroxyacid will be generally chosen at a solids content of at least 5% and preferably with a solids content of at least 10%. In most cases the consistency will not exceed a solids content of 40% and, preferably, 30%.

In the process according to the invention the quantity of organic peroxyacid which is employed is chosen as a function of the residual lignin content in the pulp and of the average duration of treatment. Quantities of at least 0.1% and, preferably, of at least 1% by weight of peroxyacid relative to the dry pulp are generally suitable. In most cases a quantity of peroxyacid not exceeding 10% by weight relative to the dry pulp and, preferably, not exceeding 5% of this weight will be employed.

According to the invention the stabiliser used belongs to the class of phosphonic acids and their salts. It will preferably be selected from 1-hydroxyethylidene- 1,1-diphosphonic acid (HEDPA), ethylenediaminetetra(methylenephosphonic) acid (EDTMPA), diethylenetriaminepenta(methylenephosphonic) acid (DTMPA), triethylenetetraminehexa(methylenephosphonic) acid (TTHMPA), pentaethylenehexamineocta(methylenephosphonic) acid (PHOMPA), cyclohexanediaminetetra(methylenephosphonic) acid (CDTMPA) and nitrilotri(methylenephosphonic) acid (NTMPA). DTMPA and its salts have given excellent results.

The total quantities of stabiliser to be used depend on the type of wood and on the cooking process employed. As a general rule it is recommended to use a quantity of stabiliser of at least 0.05% by weight relative to the solids content and, preferably, at least 0.2% by weight. Quantities of stabiliser not exceeding 3% by weight relative to the solids content and, preferably, not exceeding 2% by weight are generally sufficient.

The organic peroxyacid treatment according to the invention can also be performed in the presence of a number of stabilisers including at least one phosphonic acid or one of its salts and/or sodium silicate. It may also be found advantageous to combine at least one phosphonic acid and/or sodium silicate with a water-soluble magnesium salt such as magnesium sulphate.

As a variant, it may be advantageous to precede the treatment with the organic peroxyacid by at least one washing or a stage of decontaminating pretreatment by means of an acidic aqueous solution. The objective of this washing or this stage is to extract from the pulp the impurities which are present in the form of metal ions which are detrimental to the proper performance of the bleaching and/or delignifying operations. Any inorganic or organic acid employed in aqueous solution, by themselves or mixed, are suitable. Strong inorganic acids such as, for example, sulphuric acid or hydrochloric acid are well-suited.

It is advantageous for the acidic washing or decontaminating pretreatment to be furthermore carried out in the presence of a complexing agent for metal ions. To this end, mixtures of the strong inorganic acids referred to above with organic acids of the class of aminopolycarboxylic or aminopolyphosphonic acids or of their alkali metal salts are particularly suitable. Examples of suitable aminopolycarboxylic acids are diethylenetriaminepentaacetic acid, ethylenediaminetetraacetic acid (EDTA), cyclohexanediaminetetraacetic acid (CDTA) and nitrilotriacetic acid (NTA). Diethylenetriaminepentaacetic acid (DTPA) is preferred. Examples of aminopolyphosphonic acids are diethylenetriaminepenta(methyienephosphonic) acid (DTMPA), ethylenediaminetetra(methylenephosphonic) acid (EDTMPA), cyclohexanediaminetetra(methylenephosphonic) acid (CDTMPA) and nitrilotri(methylenephosphonic) acid. DTMPA is preferred. The quantities of complexing agent to be used depend on the effectiveness of the complexing agent selected and on the metal content of the pulp to be treated. In practice at least 0.01% by weight of complexing agent relative to the dry pulp and, in most cases, at least 0.05% is generally used. Similarly, 1% by weight of complexing agent relative to the dry pulp and, in most cases 0.25% is generally not exceeded.

The operating conditions of the acidic decontaminating pretreatment are not critical. They must be determined in each individual case as a function of the type of paper pulp and of the equipment in which the treatment is performed. As a general rule it is appropriate to fix the choice of the acid and the quantity used to impart to the mixture a pH lower than 7, for example of between approximately 1 and approximately 6.5. pH values that are especially advantageous are those included between approximately 3.0 and approximately 6.0. The temperature and the pressure are not critical, ambient temperature and atmospheric pressure being generally suitable. The duration of the pretreatment may vary within wide proportions depending on the type of equipment employed, the choice of the acid, the temperature and the pressure, for example from approximately 15 minutes to several hours.

It may also be advantageous, in certain particular circumstances depending on the wood species employed and on the type of cooking used to prepare the pulp, to insert between the cooking operation and the treatment with the peroxyacid one or more additional stages of delignification of the pulp by means of chemical reactants. Delignification by means of chemical reactants is intended to denote both nonoxidising reactants such as an alkaline reactant like sodium, magnesium or calcium hydroxide or carbonate, and oxidising reactants in an acidic medium, such as chlorine, chlorine dioxide, ozone, an inorganic peroxyacid such as peroxymonosulphuric acid, hydrogen peroxide in acidic medium and oxidising reactants in alkaline medium, such as hydrogen peroxide in alkaline medium, sodium or calcium hypochlorite, molecular oxygen or ozone. It is also possible to combine two or a number of these reactants in a single treatment stage.

In an alternative form of the process according to the invention it is possible, if it is desired to obtain high brightness values, to follow the treatment with a peroxyacid with a sequence of conventional stages of bleaching by means of chemical reactants optionally involving chlorine-containing reactants. Examples of such stages are the following: stages with gaseous oxygen or ozone, stages with alkaline hydrogen peroxide in the optional presence of gaseous oxygen, stages with chlorine dioxide or with sodium hypochlorite and alkaline extraction with caustic soda.

According to a preferred alternative form of the process according to the invention the treatment with peroxyacid is followed by a stage of bleaching with hydrogen peroxide in alkaline medium. This stage with hydrogen peroxide in alkaline medium may be advantageously performed by employing the hydrogen peroxide which generally accompanies the peroxyacid: at the end of the treatment with the peroxyacid an alkali is added to the pulp and bleaching with hydrogen peroxide is then carried out without performing any intermediate washing between the peroxyacid and alkaline hydrogen peroxide stages. If need be, an additional quantity of hydrogen peroxide will be added so as to reach the total quantity required for carrying out an effective bleaching.

The process in accordance with the invention applies to the delignification and bleaching of any kind of chemical pulp. It is suitable for delignifying and bleaching kraft pulps and sulphite pulps. It is particularly well suited for the treatment of kraft pulps.

EXAMPLES

The examples which follow are given for the purpose of illustrating the invention without, however, limiting its scope.

Examples 1R and 2R (not in accordance with the invention)

A sample of deciduous pulp which has undergone a kraft cooking (initial brightness 33.7° ISO, measured according to ISO standard 2470, kappa number 12.4, measured according to SCAN standard C1-59 and degree of polymerisation 1370, expressed as the number of glucose units and measured according to SCAN standard C15-62) was delignified by means of a two-stage sequence comprising a first stage with peracetic acid (Paa) and a second stage of alkaline extraction with sodium hydroxide. The pulp was washed with demineralised water between the two stages.

The peracetic acid employed was an aqueous solution at equilibrium containing 240 g/l of $CH_3CO_3H$, 420 g/l of $CH_3COOH$, 100 g/l of $H_2O_2$ and 7 g/l of $H_2SO_4$.

After delignification, determinations of brightness, of kappa number and of degree of polymerisation were performed on the treated pulp.

The operating conditions were the following:

| | |
|---|---|
| 1st stage: stage with peracetic acid (Paa stage): | |
| $CH_3CO_3H$ content, g/100 g dry pulp: | 1.0 |
| 40% DTPA or 100% EDTA content, g/100 g dry pulp: | 0.5 |
| temperature, degrees C.: | 90 |
| duration, min: | 240 |
| consistency, % by weight of solids content: | 10 |
| 2nd stage: stage with Na hydroxide (E stage): | |
| NaOH content, g/100 g dry pulp: | 2.0 |
| temperature, degrees C.: | 90 |
| duration, min: | 45 |
| consistency, % by weight of solids content: | 10 |

The results obtained are given in the table which follows:

| Example No. | Nature of the stabiliser | pH Paa stage init. | pH Paa stage fin. | Final brightness °ISO | Final kappa number | Final DP |
|---|---|---|---|---|---|---|
| 1R | DTPA | 4.35 | 4.20 | 48.0 | 7.73 | 750 |
| 2R | EDTA | 4.35 | 4.30 | 48.9 | 7.46 | 740 |

Example 3: (in accordance with the invention)

Examples 1R and 2R were reproduced by replacing the DTPA or EDTA stabiliser with 0.5 g of the heptasodium salt of diethylenetriaminepenta(methylenephosphonic) acid ($Na_7DTMP$) per 100 g of dry pulp.

The results obtained were:

| Example No. | Nature of the stabiliser | pH Paa stage init. | pH Paa stage fin. | Final bright-ness °ISO | Final kappa number | Final DP |
|---|---|---|---|---|---|---|
| 3 | $Na_7DTMP$ | 4.35 | 4.40 | 48.2 | 7.63 | 1250 |

Example 4: (in accordance with the invention)

A coniferous pulp which had undergone a kraft cooking, of brightness 30.5° ISO, kappa number 26.7 and degree of polymerisation of 1510 was bleached by means of a sequence completely free from chlorine-containing reactants in 4 stages O Q P Paa under the following operating conditions:

| | |
|---|---|
| 1st stage: oxygen stage (O) | |
| pressure, bar: | 5.5 |
| NaOH content, g/100 g dry pulp: | 4.0 |
| $MgSO_4.7H_2O$ content, g/100 g dry pulp: | 0.5 |
| temperature, degrees C.: | 120 |
| duration, min: | 60 |
| consistency, % by weight of solids content: | 14 |
| 2nd stage: stage with a sequestering acid | |
| 40% DTPA content, g/100 g of dry pulp: | 0.5 |
| $H_2SO_4$ for initial pH of: | 5.00 |
| temperature, degrees C.: | 55 |
| duration, min: | 30 |
| consistency, % by weight of solids content: | 4.0 |
| 3rd stage: stage with $H_2O_2$ (P) | |
| $H_2O_2$ content, g/100 g of dry pulp: | 2.0 |

-continued

| | |
|---|---|
| NaOH content, g/100 g of dry pulp: | 1.5 |
| temperature, degrees C.: | 90 |
| duration, min: | 120 |
| consistency, % by weight of solids content: | 10 |
| 4th stage: stage with peracetic acid (Paa) | |
| Paa content, g/100 g of dry pulp: | 3.0 |
| $Na_7DTMP$ content, g/100 g of dry pulp: | 0.5 |
| temperature, degrees C.: | 90 |
| duration, min: | 240 |
| consistency, % by weight of solids content: | 10 |

The results obtained were as follows:

| Example No. | Nature of the stabiliser | pH Paa stage init. | pH Paa stage fin. | Final brightness °ISO | Final kappa number | Final DP |
|---|---|---|---|---|---|---|
| 4 | $Na_7DTMP$ | 3.6 | 3.4 | 68.8 | 4.61 | 1070 |

Examples 5R, 6R and 7R (not in accordance with the invention) and 8, 9 and 10 (in accordance with the invention)

A sample of coniferous kraft pulp (initial brightness 30.5° ISO, measured according to ISO standard 2470, kappa number 26.7, measured according to SCAN standard C1-59 and degree of polymerisation 1510, expressed as the number of glucose units and measured according to SCAN standard C15-62) was delignified by means of a two-stage sequence comprising a first stage with peracetic acid (Paa) and a second stage of alkaline extraction with sodium hydroxide. The pulp was washed with demineralised water between the two stages.

The peracetic acid employed was an aqueous solution at equilibrium containing 240 g/l of $CH_3CO_3H$, 420 g/l of $CH_3COOH$, 100 g/l of $H_2O_2$ and 7 g/l of $H_2SO_4$.

After delignification determinations of brightness of kappa number and of degree of polymerisation were performed on the treated pulp.

The operating conditions were the following:

| Example No. | Reactants: Stage 1 $CH_3CO_3H$ content g/100 g d.p. | Stage 1 $Na_7DTMP$ content g/100 g d.p. | Stage 1 36° Bé silicate g/100 g d.p. | Stage 1 $MgSO_4.7H_2O$ content g/100 g d.p. | Stage 2 NaOH content g/100 g d.p. |
|---|---|---|---|---|---|
| 5R | 3 | 0 | 3 | 0 | 2 |
| 6R | 3 | 0 | 0 | 1 | 2 |
| 7R | 3 | 0 | 3 | 1 | 2 |
| 8 | 3 | 0.5 | 3 | 0 | 2 |
| 9 | 3 | 0.5 | 0 | 1 | 2 |
| 10 | 3 | 0.5 | 3 | 1 | 2 |

where $Na_7DTMP$ symbolises the heptasodium salt of diethylenetriaminepenta(methylenephosphonic) acid. In all the examples 5R, 6R and 7R and 8, 9 and 10 the same operating conditions which follow were applied:

| | Stage 1 | Stage 2 |
|---|---|---|
| temperature, °C.: | 90 | 90 |

-continued

| | Stage 1 | Stage 2 |
|---|---|---|
| duration, min: | 240 | 45 |
| consistency, % by weight of solids content: | 10 | 10 |

After treatment, determinations of brightness, of kappa number and of degree of polymerisation were performed on the pulp.

The results obtained were as follows:

| Example No. | Final brightness, °ISO | Final kappa number | Final DP |
|---|---|---|---|
| 5R | 38.1 | 13.8 | 820 |
| 6R | 38.1 | 13.3 | 870 |
| 7R | 37.9 | 13.4 | 630 |
| 8 | 40.7 | 14.4 | 1350 |
| 9 | 40.5 | 14.6 | 1380 |
| 10 | 41.4 | 14.4 | 1360 |

I claim:

1. A process for improving the selectivity of the delignification of a chemical paper pulp by means of an organic peroxyacid, comprising the step of: treating an unbleached pulp originating from a cooking operation with an aqueous solution of the organic peroxyacid containing at least 10% by weight of peroxyacid in the presence of a stabilizer for the peroxyacid, said stabilizer comprising at least one compound selected from the group consisting of phosphonic acids and their salts, wherein the organic peroxyacid is fed in an amount sufficient to delignify the unbleached pulp and produce a delignified chemical pulp.

2. The process according to claim 1, wherein the organic peroxyacid is peracetic acid.

3. The process according to claim 1, wherein the treatment with organic peroxyacid is performed at a temperature of between 50° and 98° C.

4. The process according to claim 1, wherein the phosphonic acid is diethylenetriaminepenta(methylenephosphonic) acid.

5. The process according to claim 1, wherein the stabiliser additionally comprises sodium silicate.

6. The process according to claim 1, wherein the stabiliser for the peroxyacid is a combination of a phosphonic acid or of one of its salts with a water-soluble magnesium salt.

7. The process according to claim 1, wherein at least one washing operation or a stage of treatment with an acidic aqueous solution is carried out before the treatment with organic peroxyacid.

8. The process according to claim 1, wherein one or more stages of delignification of the pulp by means of chemical reactants is inserted between the cooking operation and the treatment with the peroxyacid.

9. The process according to claim 1, wherein the treatment with the peroxyacid is followed by a stage of bleaching with hydrogen peroxide in alkaline medium.

10. A process for improving the selectivity of the delignification of a kraft paper pulp by means of an organic peroxyacid, comprising the step of: treating an unbleached pulp originating from a cooking operation with an aqueous solution of the organic peroxyacid containing at least 10% by weight of peroxyacid in the presence of a stabiliser for the peroxyacid, said stabiliser comprising at least one compound selected from the group consisting of phosphonic acids and their salts, wherein the organic peroxyacid is fed in an amount sufficient to delignify the unbleached pulp and produce a delignified kraft paper pulp.

11. A process for improving the selectivity of the delignification of a sulphite paper pulp by means of an organic peroxyacid, comprising the step of treating an unbleached pulp originating from a cooking operation with an aqueous solution of the organic peroxyacid containing at least 10% by weight of peroxyacid in the presence of a stabiliser for the peroxyacid, said stabiliser comprising at least one compound selected from the group consisting of phosphonic acids and their salts, wherein the organic peroxyacid is fed in an amount sufficient to delignify the unbleached pulp and produce a delignified sulphite paper pulp.

12. A process for improving the selectivity of the delignification of a chemical paper pulp, obtained by a cooking process employing solvents, by means of an organic peroxyacid, comprising the step of treating an unbleached pulp originating from a cooking operation with an aqueous solution of the organic peroxyacid containing at least 10% by weight of peroxyacid in the presence of a stabiliser for the peroxyacid, said stabiliser comprising at least one compound selected from the group consisting of phosphonic acids and their salts, wherein the organic peroxyacid is fed in an amount sufficient to deliqnify the unbleached pulp and produce a delignified chemical pulp.

* * * * *